United States Patent [19]

Williams et al.

[11] 4,109,925

[45] Aug. 29, 1978

[54] SKATEBOARD CHASSIS

[75] Inventors: Michael Patrick Williams, San Diego; William Howard Brawner, El Cajon, both of Calif.

[73] Assignee: H.P.G. IV, Inc., El Cajon, Calif.

[21] Appl. No.: 852,624

[22] Filed: Nov. 18, 1977

Related U.S. Application Data

[63] Continuation-in-part of Ser. No. 732,649, Oct. 15, 1976, abandoned.

[51] Int. Cl.[2] ..... A63C 17/02

[52] U.S. Cl. ..... 280/11.28

[58] Field of Search ..... 280/87.04 A, 11.19, 280/11.27, 11.28, 11.23, 11.26

[56] References Cited

U.S. PATENT DOCUMENTS

| | | | |
|---|---|---|---|
| 2,920,899 | 1/1960 | Crone | 280/11.28 |
| 3,862,763 | 1/1925 | Ware | 280/11.28 |
| 4,047,725 | 9/1977 | Pinchock | 280/11.28 |

*Primary Examiner*—Joseph F. Peters, Jr.
*Assistant Examiner*—Gene A. Church
*Attorney, Agent, or Firm*—Brown & Martin

[57] ABSTRACT

A skateboard truck includes an axle assembly which is quickly detachable from the truck mounting pad by means of a tension bolt fitting within a slotted bracket in the mounting pad for quick detachment therefrom. The skateboard truck assembly is provided with tension screw assembly that is mounted at a less than 45° angle with respect to the skateboard and includes adjusting means for adjusting the pivot axis of the assembly with respect to the skateboard, totally independent of the adjustment of the tension in the assembly. A safety bracket includes a base portion with an arm having a cylindrical bore for receiving the cylindrical outer end of the tension bolt for reducing the stress on the board or tension bolt during the steering of the skateboard.

18 Claims, 6 Drawing Figures

SKATEBOARD CHASSIS

REFERENCE TO RELATED APPLICATION

The present application is a continuation-in-part of our co-pending application, Ser. No. 732,649, entitled "Skateboard Chassis", filed Oct. 15, 1976, now abandoned.

BACKGROUND OF THE INVENTION

The present invention relates generally to skateboards and pertains particularly to an improved skateboard truck assembly for use on skateboards.

The sport of skateboarding has exploded in popularity in recent years. The competitive sport of skateboarding includes many different styles of competition. For example, trick riding, slalom, downhill, etc., are just some of the variations that have recently developed. The more serious skateboarding pursuits subject skateboards to exacting performance characteristics. The most functional performance characteristics are controlled by the truck or chassis of the board. The truck controls the stability, maneuverability, and handling of the board. Each of the modes of skateboarding requires a different truck performance for optimum skateboard performance. Heretofore, it has not been possible to utilize a single skateboard for the different events due to the inability to adjust or quickly replace the trucks. A serious skateboarder would have to utilize a selection of different boards, each designed for a specific event.

The prior art construction of skateboard truck chassis are exemplified, for example, by U.S. Pat. No. 3,862,763, issued Jan. 28, 1975, to Gordon K. Ware. The prior art skateboard truck assembly typically employ an arrangment wherein the pivot axis is approximately 45° with the weight of the board supported predominantly on tension pads, which are oriented substantially vertically or at most a few degrees up to approximately 15° off the vertical, such as illustrated in the Ware patent. The arrangment is such that the tension in the pads can be adjusted by adjustment of the tension bolt and this can provide minor adjustments in the pivot axis of the truck assembly. However, there is no independent adjustment of the pivot axis independently of the adjustment of the tension in the tension pad. Moreover, with this arrangement, the tilting of the board with respect to the chassis which results in the major control and steering of the board is resisted predominantly by the pads. The tilt is also at substantially right angles to the axis of the tension bolt, resulting in high stress on the tension bolt.

Also, as will be readily apparent, the chassis or axle assembly cannot be replaced without affecting the adjustment of the tension pads. In other words, the tension bolt must be screwed completely out of its mounting in order to replace the axle assembly of the truck.

Additional drawbacks of the prior art include a lack of clearance at the center of the axle. The boards having axle or chassis assemblies of conventional design are unable to pass over reasonably large bumps or objects. Most such conventional trucks of a unitary axle type present very small ground clearance. As a consequence, a skateboard may frequently become grounded by an obstruction in the course way.

Accordingly it is desirable that an improved skateboard truck assembly be available which provides improved adjustment in the handling characteristics of the board as well as permit ready replacement of various axle assemblies.

SUMMARY AND OBJECTS OF THE INVENTION

It is therefore the primary object of the present invention to overcome the above problems of the prior art.

Another object of the present invention is to provide an improved skateboard truck that is adjustable, both as to steering radius and steering resistance, and these adjustments being independent.

A further object of the present invention is to provide an improved skateboard assembly that permits quick and rapid replacement of the axle assembly without affecting the adjustment in steering resistance.

A still further object of the present invention is to provide an improved skateboard assembly having improved ground clearance.

In accordance with the primary aspect of the present invention, a skateboard truck assembly is provided with a quickly detachable axle assembly having means for adjusting both the radius of turn of the assembly as well as the resistance of turning of the assembly. An additional feature of the present invention is the provision of a safety bracket.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENTS

Figure 1:
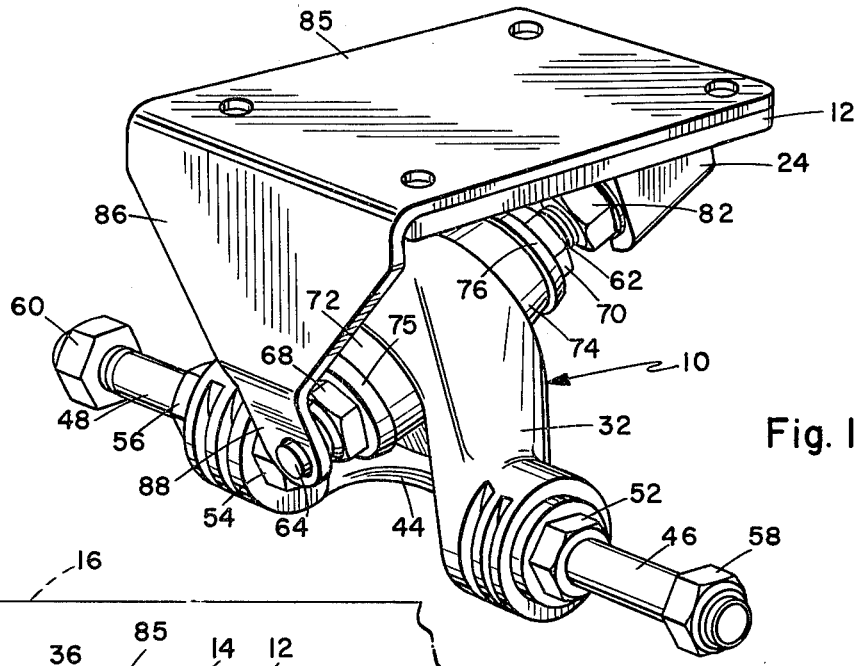
FIG. 1 is a perspective view of the truck unit.
Figure 3:
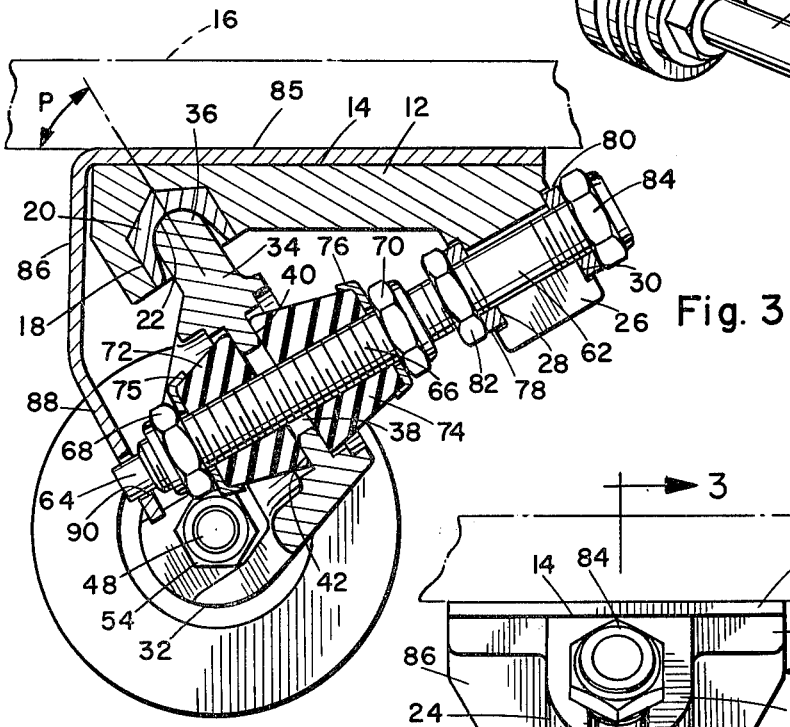
FIG. 3 is a sectional view taken on line 3—3 of FIG. 2.

Turning now to the drawing, a truck assembly constructed in accordance with the present invention is shown in FIG. 1 and designated generally by the numeral 10. This truck assembly includes a base plate 12 having a generally plane upper surface 14 for resting directly against for securing directly to the underside of a board, shown in phantom at 16. The base plate 12 includes a pivot bearing mounting bore 18 for receiving a pivot bearing 20, having a bearing surface 22 of a generally spherical bottom or bearing surface and a generally conical or frusto-conical entrance portion.

The base plate 12 further includes a mounting of a generally bifurcated configuration having a pair of spaced apart arms or legs 24 and 26, defining a slot or slit therebetween for receiving a tension bolt. Counterbores 28 and 30 are formed at each end of the slot of the bracket for receiving the retainer assemblies of the tension bolt, as will be explained.

Figure 2:
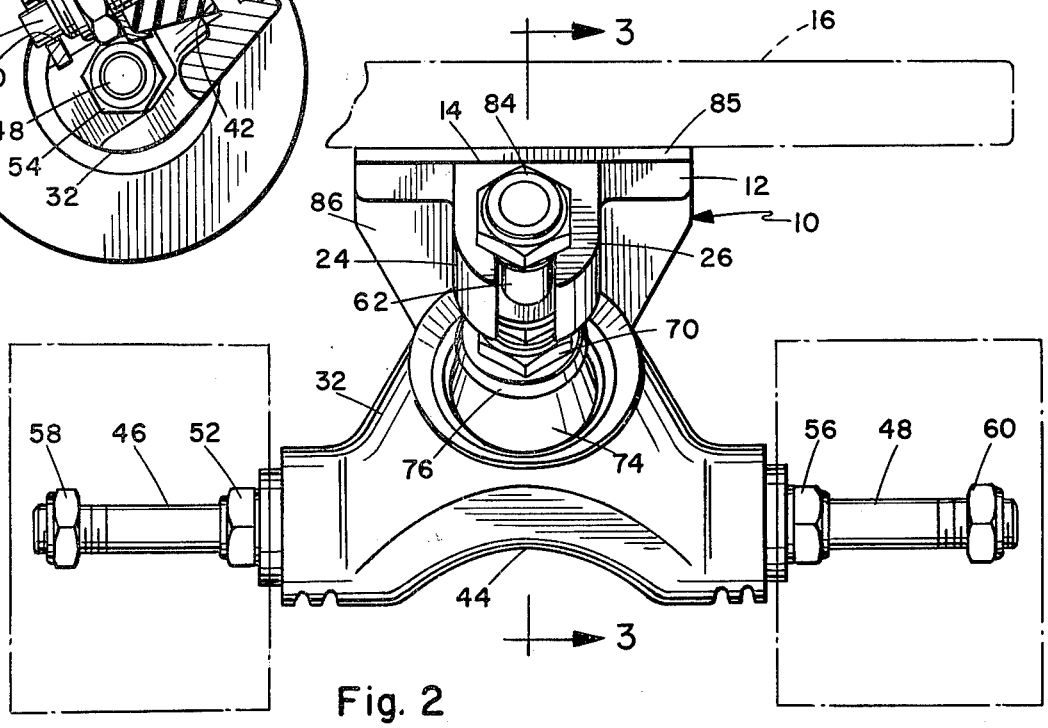
FIG. 2 is a rear elevational view of the truck unit.
Figure 4:
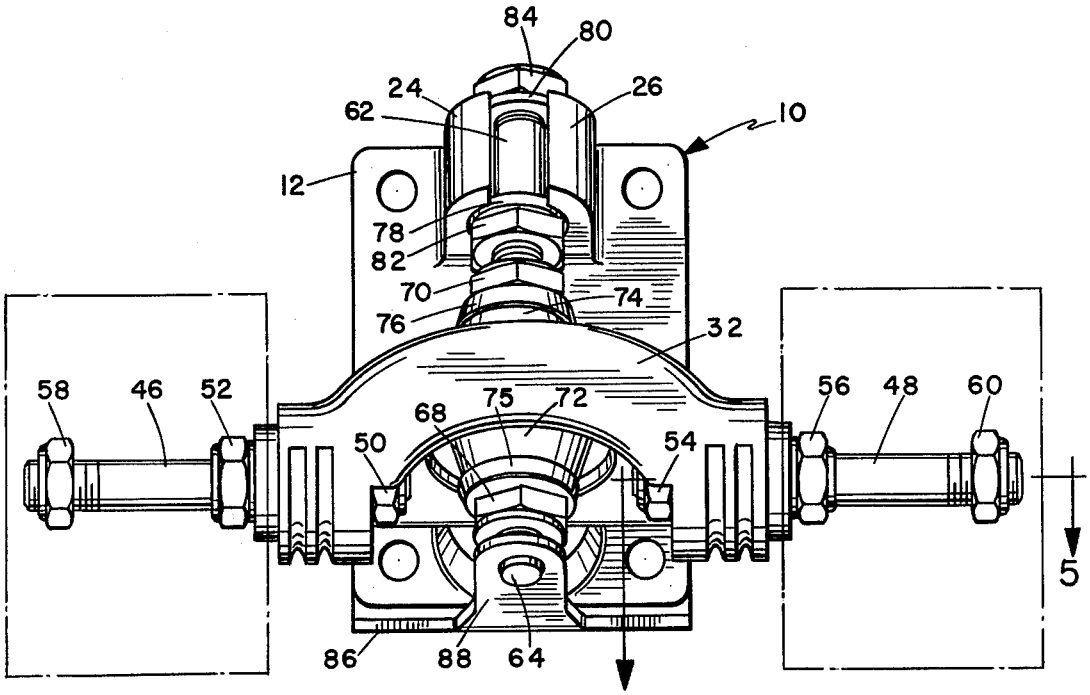
FIG. 4 is a bottom plan view of the truck unit.
Figure 5:
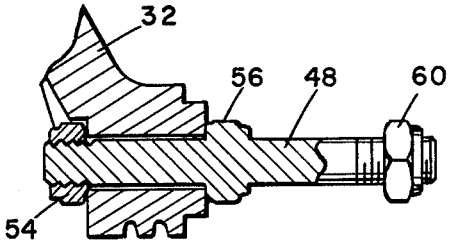
FIG. 5 is a sectional view taken on line 5—5 of FIG. 4.

The axle assembly itself comprises a central axle member 32 constructed of a suitable light weight high strength material and may be either cast or forged into shape. The central axle member includes a pivot arm 34 extending upward from the center thereof and including a pivot ball or journal 36 for fitting into the socket 22 of the pivot bearing 20. The immediate central portion of the axle includes a bore 38 extending through the center portion thereof for receiving a tension bolt, and counterbores or the like 40 and 42 at each end of the central bore 38 for receiving tension pads, as will be explained. The axle, as best seen in FIG. 2, includes a central arched portion 44 for providing clearance over obstructions in the course way. This arched section provides a clearance that is substantially equal to that presented by the axis of rotation of the wheels (i.e., the radius of the wheels). The axle assembly includes a pair of detachable axles 46 and 48, each detachably mounted in one of a pair of coaxial bores that are spaced apart and formed in the central axle member (FIG. 5). The axle each have inner and outer nuts 50, 52, 54, and 56, as best seen in FIG. 4. These nuts and arrangement of the axles permit the axles to be quickly replaced when bent or the like, or when desirable to replace wheels thereon. Additionally, the axles include nuts 58 and 60 at the outer end thereof for retaining wheels on the axles.

The axle is held in place with respect to the base plate 12 by means of a tension bolt 62 which has an inner end mounted in the mounting bracket 24, 26 and an outer end extending through and mounting to the axle member 32. Additionally, the outer end includes a cylindrical journal or the like 64 for fitting within the bore of a safety bracket, as will be described. The tension bolt 62 includes a threaded section 66 on which is threadably mounted a pair of nuts 68 and 70, between which are mounted a pair of tension pads 72 and 74. The tension pads extend into and engage the walls of the pilot bores 40 and 42 at the central axle. A pair of washers 75 and 76 engage the ends of the pads 72 and 74 between the nuts 68 and 70.

The inner end of the tension bolt 62 is mounted or retained in the mounting bracket 24 and 26 by means of a pair of washers 78 and 80, which extend into bores 28 and 30 of the brackets 24 and 26. These washers or collars 78 and 80 are biased into and retained in place by means of a pair of nuts 82 and 84 on opposite sides thereof.

In the truck assembly, as illustrated, the axle assembly is detachably mounted to the base plate 12 and is essentially retained in position thereto by means of the tension bolt 62. This axle assembly is quickly detachable from the base plate assembly or base plate 12 by simply releasing nut 84 or backing off nut 82 and 84 or either one thereof to permit the washer 78 and 80 to clear the counterbores 28 and 30. Thus, the axle assembly can be quickly removed and an identical assembly quickly placed therein. As will be seen, this can be accomplished totally independent of the adjustment of the tension in the compression or tension members 72 and 74.

The tension in the tension members 72 and 74, which affect the resistance to steering of the truck assembly, can be adjusted by adjustment of either one of nuts 68 or 70. Thus movement of these nuts towards one another compresses the tension members 72 and 74 for increasing the tension in these pads and likewise the resistance to steering and tilting of the vehicle. Furthermore, it will be noted that the pivot angle of the truck assembly P which affects the steering of the assembly can be likewise adjusted by adjustment of the nuts 68 and 70, without altering the compression of members 72 and 74. It will be appreciated that this angle can be adjusted independently of tension in the compression members 72 and 74. Thus, the two nuts 68 and 70 can be moved to the right to decrease the pivot angle P, or move to the left to increase the pivot angle P. It will be noted that this angle is approximately 60° and can be adjusted either by increasing or decreasing the angle between about 50° and 60°. Moreover, the axle of the assembly is approximately directly below the pivot point at the center of the pivot ball 36 and likewise can be adjusted from this position to selected positions aft thereof. It should be noted that these adjustments can be made to adjust the lift and tilt of the board and to adjust for the turn.

In contrast to the prior art, the tension bolt in the present construction is at approximately 30° to the pivot axis with the weight of the board supported predominantly on the pivot arm, in contrast to the prior art where support is on the tension bolt. With this arrangment the tilting of the board is essentially about the axis of the tension bolt, whereas the turning is about the pivot axis at 36. With this arrangment, shorter radius turns can be accomplished with less tension on the tension bolt. Moreover, the tension adjustment primarily adjusts the steering as opposed to the tilt of the board although these are interrelated.

An additional feature of the present invention includes a safety bracket 85, which includes a flat surface portion thereof for sandwiching between the base plate 12 and the board 16, with an outwardly extending portion 86 having an arm or finger portion 88, with a bore 90 therein for receiving the pilot end 64 of the tension bolt 62. This arrangment secures the outer end 64 of the tension bolt 62 and relieves a considerable amount of the lateral stress and pull thereon during steering and tilting of the board. It will be appreciated that in the present arrangment, as well as in the prior art constructions, the axle assembly is supported or secured in place by the tension bolt with a considerably amount of lateral stress imposed on the bolt during steering and tilting of the board. In the present arrangment, however, the addition of the safety bracket 85 not only secures the outer end of the bolt 62 in a substantially axial alignment, thereby resisting the cantilevered normal construction or support thereof, but in addition provides resistance to breakage of the tension bolt 62 should the board encounter an obstruction, such as a curb or the like. With this arrangment a considerably amount of the lateral stress is removed from the bolt 62 and transferred to the safety bracket 85. It will be noted that the safety bracket 85 does not interfere with the quick release aspects and quick detachable mounting of the present invention. The inner end of the bolt 62 is simply released from the mount and pivoted outward away from the support bearing 20 and about the bore 90 of the bracket 84.

Figure 6:
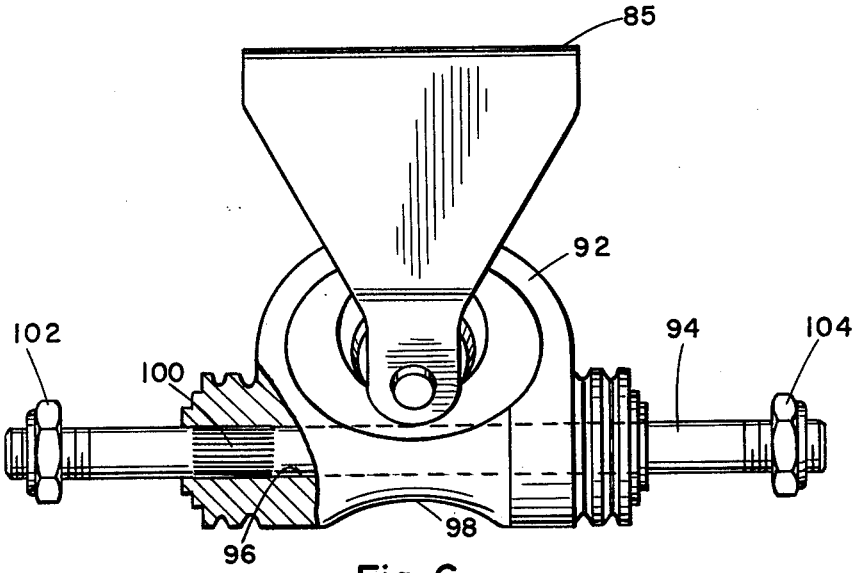
FIG. 6 is a front elevational view of an alternative structure with a one piece axle.

Turning now to FIG. 6 of the drawings, there is illustrated an alternate construction, wherein a central axle assembly 92 is provided with a single unitary axle 94 extending the entire length thereof through a bore 96 through the central axle 92. A central arched portion 98 is provided for increasing the clearance of the axle. This axle assembly provides a unitary axle 94 of higher strength than would be expected with a split axle arrangment. The axle 94 is preferably press fitted into the bore 96 and includes a suitable knurled portion 100 thereon for retaining the axle within the bore in a tight fitting non-rotatable position. A pair of nuts 102 and 104 are provided on the outer ends of the axle 94 for retention of wheels thereon. It will also be noted in both versions of the axle that the angle of the tension bolt is such that the outer end thereof is above the axle, (FIGS.

3 and 6), thereby providing greater clearance than that provided by the typical prior art construction.

While the present invention has been described and illustrated by means of specific embodiments, it is to be understood that numerous changes and modifications may be made therein without departing from the spirit and scope of the invention as defined in the appended claims.

Having described our invention, we now claim:

1. A skateboard truck assembly comprising in combination:

a mounting member for mounting to the underside of a skateboard, and including a pivot bearing socket and a tension bolt mounting means for mounting a tension bolt, an axle assembly including a central axle member having a pivot arm having a bearing end supported in said bearing socket for pivotal movement about a pivot point, a tension bolt extending through an aperature in said central axle and secured to said axle by means of a pair of tension compression pads and detachably secured in said tension bolt mounting means, and adjusting means for adjusting the position of the axle with respect to the pivot point independently of the tension in said tension pads and for adjusting the tension in said tension pads independently of the position of the axle with respect to the pivot point.

2. The skateboard truck assembly of claim 1, including releasable retaining means for releasing said tension bolt from said tension bolt mounting means independently of said tension pads.

3. The skateboard truck assembly of claim 1, wherein said tension bolt mounting means comprises a bifurcated bracket defining a slit for receiving said tension bolt, and a counterbore at each end of said slit for engagement by releasable retaining means for retaining said bolt in said slit.

4. The skateboard truck assembly of claim 3, wherein said releasable retaining means comprises a nut and a washer threadably mounted on said nut at each end of said slit, said washer adapted to fit into said counterbore and adjustably retained therein by said nut.

5. The skateboard assembly of claim 1, wherein said tension bolt extends at an angle of about 30° from said mounting pad so that said axle is supported predominately by said pivot bearing.

6. The skateboard truck assembly of claim 1, wherein said central axle member is arched for providing excess clearance at the center thereof.

7. The skateboard truck assembly of claim 6, wherein said axle includes a pair of axle journals detachably mounted in said central axle member.

8. The skateboard truck assembly of claim 1, including a safety bracket, said safety bracket comprising a base member for securing to said board, a journal arm extending outward from said base member and including a cylindrical bore therethrough, and said tension bolt including a cylindrical journal extending into said bore.

9. The skateboard truck assembly of claim 1, wherein the pivot angle of said axle is adjustable from about 50° to about 60°.

10. The skateboard truck assembly of claim 2, wherein said tension bolt mounting means comprises a bifurcated bracket defining a slit for receiving said tension bolt, and a counterbore at each end of said slit for engagement by releasable retaining means for retaining said bolt in said slit.

11. The skateboard truck assembly of claim 10, wherein said releasable retaining means comprises a nut and a washer threadably mounted on said nut at each end of said slit, said washer adapted to fit into said counterbore and adjustably retained therein by said nut.

12. The skateboard assembly of claim 11, wherein said tension bolt extends at an angle of about 30° from said mounting pad so that said axle is supported predominantly by said pivot bearing.

13. The skateboard truck assembly of claim 12, wherein said central axle member is arched for providing excess ground clearance at the center thereof.

14. The skateboard truck assembly of claim 9, wherein said tension bolt mounting means comprises a bifurcated bracket defining a slit for receiving said tension bolt, and a counterbore at each end of said slit for engagement by releasable retaining means for retaining said bolt in said slit.

15. The skateboard truck assembly of claim 14, wherein said releasable retaining means comprises a nut and a washer threadably mounted on said nut at each end of said slit, said washer adapted to fit into said counterbore and adjustably retained therein by said nut.

16. The skateboard assembly of claim 15, wherein said tension bolt extends at an angle of about 30° from said mounting pad so that said axle is supported predominantly by said pivot bearing.

17. The skateboard truck assembly of claim 16, wherein said central axle member is arched for providing ground clearance at the center thereof substantially equal to the radius of wheels mounted thereon.

18. The skateboard truck assembly of claim 5, including a safety bracket, said safety bracket comprising a base member for securing to said board, a journal arm extending outward from said base member and including a cylindrical bore therethrough, and said tension bolt including a cylindrical journal extending into said bore.

* * * * *